US009004975B1

(12) United States Patent
DeJesus

(10) Patent No.: US 9,004,975 B1
(45) Date of Patent: Apr. 14, 2015

(54) OPTICAL TOY

(71) Applicant: Ben L. DeJesus, Carson, CA (US)

(72) Inventor: Ben L. DeJesus, Carson, CA (US)

( * ) Notice: Subject to any disclaimer, the term of this patent is extended or adjusted under 35 U.S.C. 154(b) by 140 days.

(21) Appl. No.: 13/786,634

(22) Filed: Mar. 6, 2013

(51) Int. Cl.
*A63H 33/22* (2006.01)

(52) U.S. Cl.
CPC ..... *A63H 33/22* (2013.01)

(58) Field of Classification Search
CPC ..... A63H 33/22; G09B 23/22
USPC ..... 446/219; 434/276, 303; 345/7; 359/850, 359/852, 853, 857, 858
See application file for complete search history.

(56) References Cited

U.S. PATENT DOCUMENTS 4,671,625 A * 6/1987 Noble ..... 359/726
5,061,052 A 10/1991 DeJesus
5,552,934 A * 9/1996 Prince ..... 359/629
5,800,236 A * 9/1998 Joun ..... 446/46
6,364,490 B1 * 4/2002 Krause ..... 353/77
6,817,716 B1 * 11/2004 Hines ..... 353/10
7,016,116 B2 * 3/2006 Dolgoff ..... 359/630
7,038,851 B2 * 5/2006 Ishikawa et al. ..... 359/463
7,148,859 B2 * 12/2006 Suyama et al. ..... 345/6
7,336,423 B2 * 2/2008 Leu et al. ..... 359/642
7,562,983 B2 * 7/2009 Kim et al. ..... 353/10
8,040,617 B2 * 10/2011 Jang ..... 359/743
8,446,339 B2 * 5/2013 Tomisawa et al. ..... 345/4
2008/0192111 A1 * 8/2008 Ijzerman ..... 348/51

* cited by examiner

*Primary Examiner* — Kurt Fernstrom
(74) *Attorney, Agent, or Firm* — Morland C. Fischer

(57) ABSTRACT

An optical toy adapted to enable a user, such as a child, to see a 3-dimensional image that is representative of an object being held in front of the toy. The toy includes a frame which surrounds a set of optical components and an optical components carrier. The set of optical components of the toy includes an optically-transparent (e.g., convex) lens and a reflective (e.g., concave) mirror surface that is located behind the transparent lens. The optical components carrier to which the set of optical components of the toy is attached is removable from the rear of the frame to be replaced by a different carrier having a different set of optical components.

16 Claims, 3 Drawing Sheets

OPTICAL TOY

BACKGROUND OF THE INVENTION

1. Field of the Invention

This invention relates to an optical toy having optical components that enable a user (e.g., a child) to see a 3-dimensional image corresponding to an object that is held in front of the toy. The optical components of the toy include an optically-transparent lens and a reflective mirror surface that is located behind and in axial alignment with the lens.

2. Background Art

On occasion, it may be desirable to have access to a simple, inexpensive toy to occupy the time of children of all ages. By way of example, a particular toy that may be of interest to children is one that has optical components adapted to produce a distinctive visual effect when the toy is looked into by a child. It may also be desirable to have an optical toy that is adapted to produce different visual effects by substituting one set of removable optical components for another.

SUMMARY OF THE INVENTION

In general terms, a simple, inexpensive optical toy is disclosed having optical components adapted to show a 3-dimensional image corresponding to an object that is held by a user in front of the toy. Such a toy has particular application to be used by a child. The toy includes a decorative outer frame in which the optical components of the toy are housed. The optical components are attached to a carrier which is removable from the frame so that one set of optical components having first optical characteristics can be substituted for a different set of optical components having different optical characteristics.

In a first case, each set of optical components includes an optically-transparent convex lens and a reflector that is located behind and in axial alignment with the lens. The reflector is preferably one of a concave, a convex or a flat mirror. In the alternative, the reflector can simply be a reflective mirror coating applied to the rear of the convex lens. In another case, the optical components include an optically-transparent Fresnel lens and a concave mirror located behind the Fresnel lens. The transparent lens and the reflector are held one in front of the other by the optical components carrier which includes planar front and back supports that extend across the frame and a pair of spacers which run between the front and back supports to hold the lens and reflector in place at the center of the frame. A viewing area is removed (e.g., cut) from the planar front support to enable the user to have visual access to the transparent lens in front of the reflector. The object (e.g., a pencil or the user's fingers) located by the user in front of the optically-transparent lens is reflected off the reflector so as to appear in 3 dimensions in the lens as if the object were moving towards the user.

DESCRIPTION OF THE PREFERRED EMBODIMENT

Figure 1:
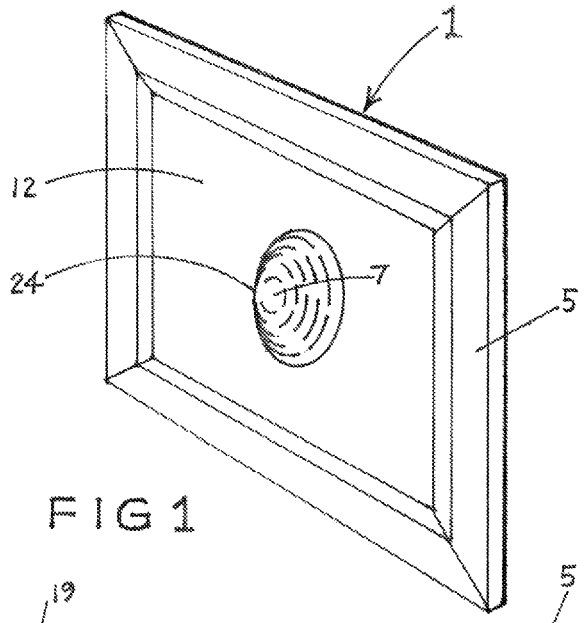
FIG. 1 is a perspective view of an optical toy according to a first preferred embodiment of this invention.
Figure 3:
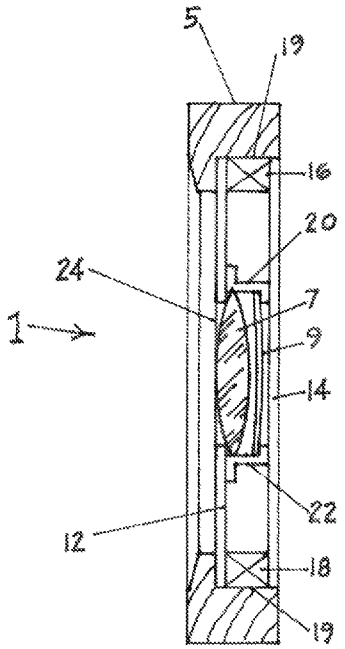
FIG. 3 is a front view of the optical toy shown in FIG. 1.
Figure 2:
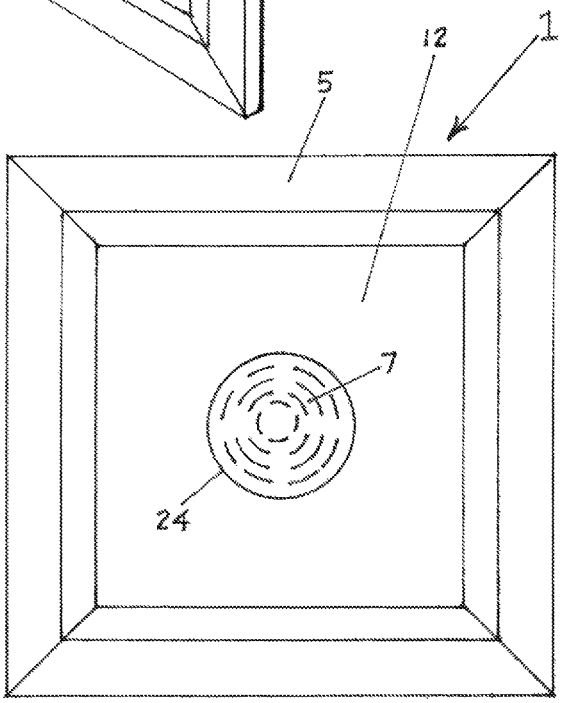
FIG. 2 is a cross-section of the optical toy of FIG. 1 having a decorative outer frame surrounding a set of optical components and an optical components carrier.

Referring initially to FIGS. 1-3 of the drawings, there is illustrated an optical toy 1 adapted to show a 3-dimensional image of an object that is hold by a user in front of the toy. That is, and as will be explained in greater detail hereinafter, the optical toy 1 has optical components which are aligned with one another to enable a user to look into the toy and see the object (e.g., a pencil) appear to be coming towards him in 3 dimensions. In this same regard, the user can also look into the toy and see his fingers appear as if they are moving towards him in dimensions. In its preferred embodiment, the toy 1 is portable so as to be held and carried in the hands of and used by a child. However, the actual size of the toy and the identity of its user are not to be considered as limitations of this invention. Therefore, it is within the scope of this invention for the size of the toy to be expanded to be used as a stationary amusement device by a single or a group of individuals at a party, a carnival, or as a wall hanging at home.

The optical toy 1 is surrounded by a decorative outer frame 5 to enhance the ornamental appearance thereof. In the example shown in FIGS. 1-3, the frame 5 is manufactured from finished wood and arranged in a rectangular configuration. The optical components and a carrier for the optical components of the toy 1 are held in place at the center of the frame 5. In order to produce a 3-dimensional visual effect, the optical components of the toy 1 include an optically-transparent lens 7 and a reflective mirror 9. The mirror 9 is located behind and spaced from the lens 7. Both the lens 7 and the mirror 9 are manufactured from glass or any other suitable optical material, such as plastic, or the like.

According to a first preferred embodiment, the front of the transparent lens 7 is convex, and the reflective mirror 9 that is located behind the lens 7 is concave. The concave mirror 9 is slightly curved to form an arc of a circle. The spacing between the lens 7 and the mirror 9 can be selected to vary the size of the 3-dimensional image that will be visible to the user who looks into the convex lens 7.

The convex lens 7 and the concave mirror 9 are suspended at the center of the frame 5 by means of the optical components carrier which includes planar front and back supports 12 and 14 that extend across the frame. The front and back supports 12 and 14 are retained in spaced, parallel alignment with one another by end blocks 16 and 18 to which the supports are fastened (e.g., glued). The end blocks. 16 and 18 and the planar front and back supports 12 and 14 are received and retained within respective channels 19 which nm along the inside of the frame 5. The front and back supports 12 and 14 are preferably manufactured from heavy paper (e.g., mat board), and the end blocks 16 and 18 are preferably manufactured from wood.

A pair of upper and lower spacers 20 and 22 of the optical components carrier hold the convex lens 7 and the concave mirror 9 one in front of the other at the center of the frame 5. The spacers 20 and 22 are fastened between the front and back supports 12 and 14 so as to engage the top and bottom of lens 7 and mirror 9, whereby to secure the lens and mirror in place.

The planar back support 14 extends continuously along the back of the frame 5 between the end blocks 16 and 18. The planar front support 12 extends continuously along the front of the frame 5 between end blocks 16 and 18, except that a viewing area 24 is removed (e.g., cut out) from the front support 12 to enable the user to we the 3-dimensional image or the object which is positioned in front of the lens 7 and reflected by the mirror 9 back to the user. The viewing area 24 may be circular (as shown), square, rectangular, etc. The planar front support 12 and the viewing area 24 removed therefrom may be recessed at the front of the frame 5 for aesthetic purposes.

To facilitate the assembly of the optical toy 1 herein disclosed, the optical components the convex transparent lens 7 and the concave reflective mirror 9) can be attached to the optical components carrier (i.e., the planar front and back supports 12 and 14, end blocks 16 and 18, and the upper and lower spacers 20 and 22) outside the frame 5. The combination or the aforementioned optical components attached to the optical components carrier may be simply pushed as a unit inwardly through the back of the frame 5 and secured in place within the channels 19 inside the frame by means of friction or any suitable adhesive.

Figure 7:
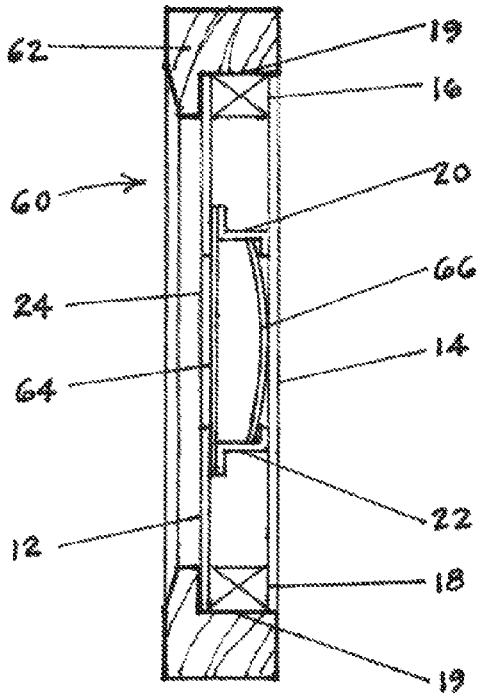
FIG. 7 is a cross-section of an optical toy having a decorative outer frame surrounding another set of optical components and an optical components carrier according to a fifth preferred embodiment of this invention.
Figure 8:
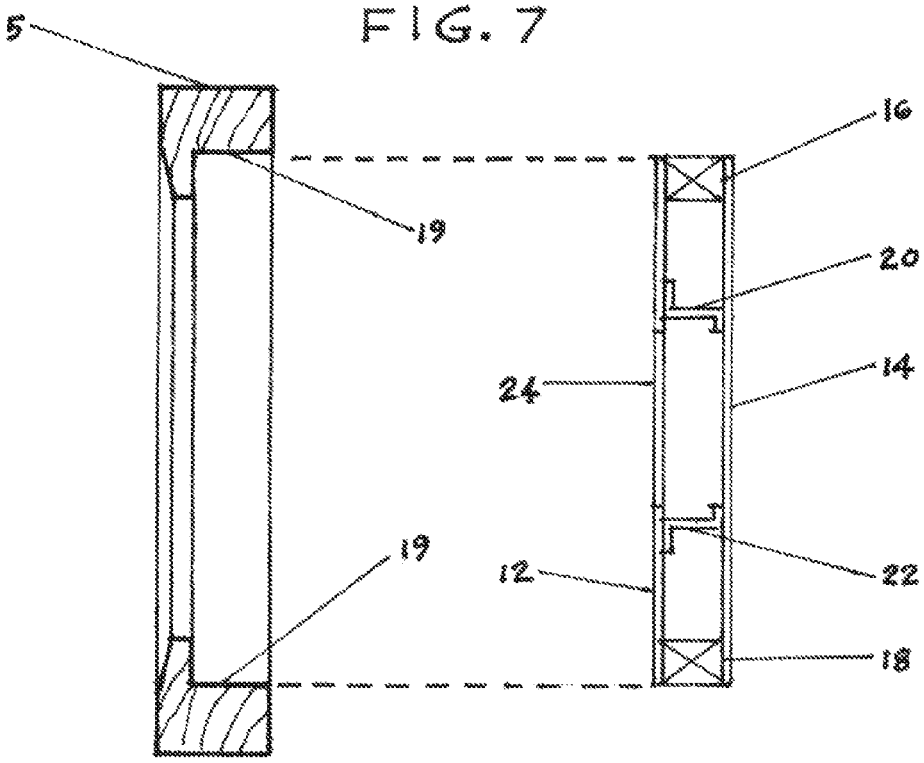
FIG. 8 illustrates the optical components carrier being removed from the decorative miter frame or any of the optical toys of FIGS. 3-7.

In this same regard, and as is best illustrated in FIG. 8 of the drawings, the optical components carrier (including the planar front and back supports 12 and 14, end blocks 16 and 18, and the upper and lower spacers 20 and 22) attached to a first set of optical components can be detached and removed as a unit from the back of the frame 5. In this case, a carrier which includes different optical components (such as any of those shown in FIGS. 4-7) having different optical characteristics can be substituted for the original optical components to maximize the versatility of the toy 1.

Figure 4:
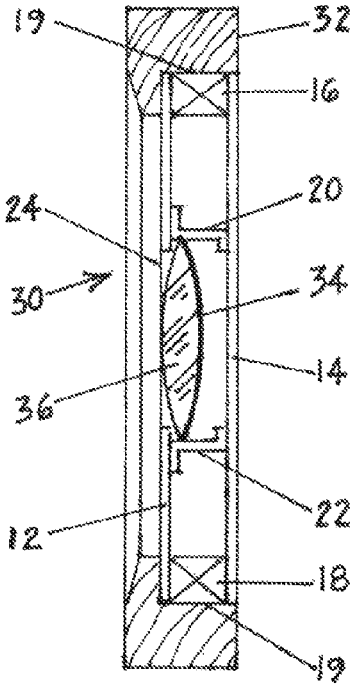
FIG. 4 is a cross-section of an optical toy having a decorative miter frame surrounding a different set of optical components and an optical components carrier according to a second preferred embodiment of this invention.

An alternate embodiment for an optical toy 30 that is also adapted to provide a 3-dimensional image of an object that is held in front of the toy is shown in FIG. 4 of the drawings. Like the toy 1 of FIGS. 1-3, the optical toy 30 of FIG. 4 has optical components and an optical components carrier that are attached to one another. As previously described, the optical components carrier can be pushed as a unit inwardly through or removed from the back of a decorative outer frame 32. The optical components carrier (including planar front and back supports 12 and 14, end blocks 16 and 18, and upper and lower spacers 20 and 22) of the toy 30 may be identical to those used for the toy 1. Therefore, identical reference numerals have been used to show and describe the removable optical component carriers of the toys 1 and 30.

However, the concave reflective mirror 9 which is held behind the convex lens 7 in the toy 1 of FIGS. 1-3 is replaced by a (e.g., metallic) reflective mirror coating 34 that is applied over the rear of an optically-transparent lens 36 having a convex face. The lens 36 is held at the center of the frame 32 by the optical components carrier and is visible to the user through a viewing area 24 that is removed from the planar front support 12. The mirror coating 34 or the lens 36 of the toy 30 of FIG. 4 has the same (i.e., concave) curvature as the concave reflective mirror 9 of the toy 1 of FIGS. 1-3. However, instead of being spaced behind the convex lens as in the case of the toy 1, the reflective coating 34 of the toy 30 lies in intimate contact with the concave rear of the lens 36. Nevertheless, when an object is held by the user in front of the optical toy 30, a 3-dimensional image corresponding to the object will be reflected by the mirror coating 34 back to the user at the convex face of the lens 36.

Figure 5:
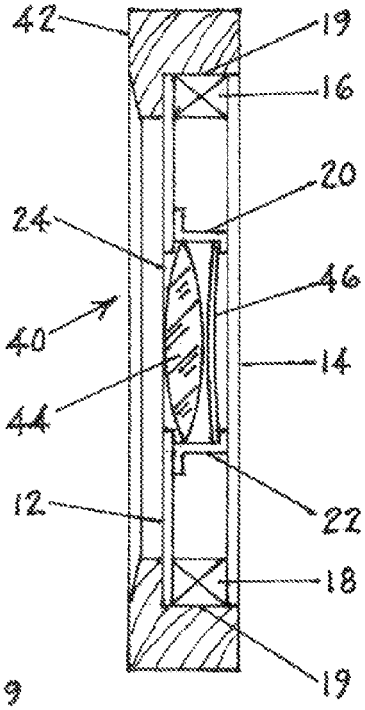
FIG. 5 is a cross-section of an optical toy having a decorative outer frame surrounding yet another set of optical components and an optical components carrier according to a third preferred embodiment of this invention.

Another preferred embodiment for an optical toy that is adapted to reflect a 3-dimensional image of an object that is held in front of the toy is illustrated at FIG. 5 of the drawings. Like the toys 1 and 30 of FIGS. 1-4, the optical toy 40 of FIG. 5 has optical components and an optical components carrier that are attached to one another such that the optical components carrier can be pushed as a unit inwardly through or removed from the back of a decorative outer frame 42. The optical components carrier (including planar front and back supports 12 and 14, end blocks 16 and 18, and upper and lower spacers 20 and 22) of the toy 40 may be identical to those of the toys 1 and 30. Therefore, identical reference numerals have been used to show and describe the removable optical components carriers of the toys 1, 30 and 40.

Like the toys 1 and 30 previously described, the optical components of the optical toy 40 of FIG. 5 include an optically-transparent convex lens 44 which is held at the center of the frame 42 and is visible to the user through a viewing area 24 that is removed from the planar front support 12 of the optical components carrier. However, unlike the toys 1 and 30, the optical components of the toy 40 also include a convex reflective mirror 46 that is located behind the convex lens 44 so as to lie in axial alignment with the lens 44 and the viewing area 24 removed from the front support 12. As in the case of the toys 1 and 30, when an object is positioned in front of the optical toy 40, a 3-dimensional image corresponding to the object will be reflected by the convex mirror 46 back to the user at the convex lens 44 so that the image appears to move out of the lens 44 and towards the user.

Figure 6:
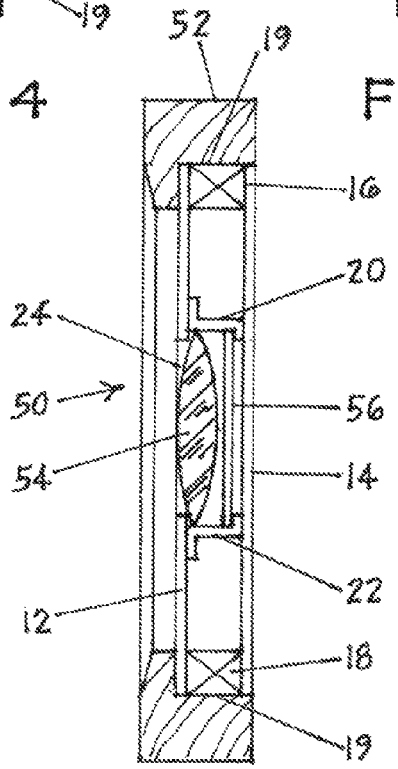
FIG. 6 is a cross-section of an optical toy having a decorative outer frame surrounding still another set of optical components and an optical components carrier according to a fourth preferred embodiment of this invention.

Still another preferred embodiment for an optical toy that is adapted to show a 3-dimensional image of an object that is held in front of the toy is illustrated at FIG. 6 of the drawings. Like the toys 1, 30 and 40 of FIGS. 1-5, the optical toy 50 of FIG. 6 has optical components and an optical components carrier which are attached to one another, such that the optical components carrier can be pushed as a unit inwardly through or removed from the back of a decorative outer frame 52. The optical components carrier (including planar front and back supports 12 and 14, end blocks 16 and 18, and upper and lower spacers 20 and 22) of the toy 50 may be identical to those of the toys 1, 30 and 40. Therefore, identical reference numerals have been used to show and describe the removable optical components carriers of the toys 1, 30, 40 and 50.

Like the toys 1, 30 and 40 previously described, the optical components of the optical toy 50 of FIG. 6 include an optically-transparent convex lens 54 which is held at the center of the frame 52 and is visible to the user through a viewing area 24 that is removed from the planar front support 12 of the optical components carrier. However, unlike the toys 1, 30 and 40, the optical components of the toy 50 also include a flat or planar reflective mirror 56 that is located behind the convex lens 54 so as to lie in axial alignment with the lens 54 and the viewing area 24 through the front support 12. As in the case of the toys 1, 30 and 40, when an object is positioned in front of the optical toy 50, a 3-dimensional image corresponding to the object will be reflected by the flat mirror 56 and appear to move towards the user from the convex lens 54.

An additional preferred embodiment for an optical toy that is adapted to make an object that is held in front of the toy appear in 3 dimensions is illustrated at FIG. 7 of the drawings. The optical toy 60 of FIG. 7 has optical components and an optical components carrier that are attached to one another, such that the optical components carrier can be pushed as a unit inwardly through or removed from the back of a decorative frame 62. The optical components carrier (including planar front and back supports 12 and 14, end blocks 16 and 18, and upper and lower spacers 20 and 22) of the toy 60 may be identical to those of the toys 1, 30, 40 and 50. Therefore, identical reference numerals have been used to show and describe the optical components carriers of the toys 1, 30, 40, 50 and 60.

The optical components of the toy 60 of FIG. 7 include a flat Fresnel lens 64 which is held at the center of the frame 62 and is visible to the user through a viewing area 24 that is removed from the planar front support 12 of the optical components carrier. The Fresnel lens 64 is adapted to magnify the image which is visible to the user in 3 dimensions. The optical components of the toy 60 also include a concave lens 66 that is located behind the planar Fresnel lens 64 so as to lie in axial alignment with the lens 64 and the viewing area 24 through the front support 12. As in the case of the other toys 1, 30, 40 and 50, when an object is positioned in front of the optical to 60, a 3-dimensional image corresponding to the object will be reflected by the concave lens 66 so as to appear to move out of the Fresnel lens 64 and towards the user.

The invention claimed is:

1. An optical toy including optical components adapted to enable a user to see a 3-dimensional image that is representative of an object held in front of the toy and an optical components carrier to which said optical components are attached, said optical components comprising a two-sided optically-transparent convex lens and a reflective mirror surface located behind the two-sided optically-transparent convex lens, said two-sided optically-transparent convex lens having front and rear sides that curve in opposite directions away from one another, whereby the object held in front of the two-sided optically-transparent convex lens is reflected by the reflective mirror surface so as to appear to the user in said two-sided optically-transparent convex lens in 3 dimensions.

2. The optical toy recited in claim 1, wherein said reflective mirror surface located behind said two-sided optically-transparent convex lens is a concave mirror that curves in the same direction as the rear side of said two-sided convex lens.

3. The optical toy recited in claim 1, wherein said reflective mirror surface located behind said two-sided optically-transparent convex lens is a reflective coating applied to the rear side of said two-sided convex lens.

4. The optical toy recited in claim 1, wherein said reflective mirror surface located behind said two-sided optically-transparent convex lens is a convex mirror that curves in the same direction as the front side of said two-sided convex lens.

5. The optical toy recited in claim 1, wherein said reflective mirror surface located behind said two-sided optically-transparent convex lens is a flat mirror.

6. The optical toy recited in claim 1, also including a frame surrounding said optical components carrier and said optical components attached to said optical components carrier, said optical components carrier and said optical components being removable as a unit from said frame.

7. The optical toy recited in claim 1, also including a frame surrounding said optical components carrier and said optical components attached to said optical components carrier, said optical components carrier comprising front and rear supports extending across said frame for holding said two-sided optically-transparent convex lens in front of said reflective mirror surface.

8. The optical toy recited in claim 7, wherein the front support of said optical components carrier is located in front of said two-sided optically-transparent convex lens and the rear support of said optical components carrier is located behind said reflective mirror surface, said front support having a viewing area removed therefrom to permit visual access to said two-sided optically-transparent convex lens.

9. The optical toy recited in claim 8, wherein said optical components carrier also comprises spacers located between the front and rear supports to retain said front and rear supports in spaced parallel alignment across said frame.

10. An optical toy including optical components adapted to enable a user to see a 3-dimensional image that is representative of an object held in front of the toy and an optical components carrier to which said optical components are attached, said optical components comprising a two-sided optically-transparent convex lens and a reflective concave mirror surface located behind the two-sided optically-transparent convex lens, said two-sided optically-transparent convex lens having front and rear sides that curve in opposite directions away from one another, and said concave mirror surface curving in the same direction as the rear side of said two-sided optically-transparent convex lens, whereby the object held in front of the two-sided optically-transparent convex lens is reflected by the concave mirror surface so as to appear to the user in said two-sided optically-transparent convex lens in 3 dimensions.

11. The optical toy recited in claim 10, also including a frame surrounding said optical components carrier and said optical components attached to said optical components carrier, said optical components carrier and said optical components being removable as a unit from said frame.

12. The optical toy recited in claim 10, also including a frame surrounding said optical components carrier and said optical components attached to said optical components carrier, said optical components carrier comprising front and rear supports extending across said frame for holding said two-sided optically-transparent convex lens in front of said concave mirror surface.

13. The optical toy recited in claim 12, wherein the front support of said optical components carrier is located in front of said two-sided optically-transparent convex lens and the rear support of said optical components carrier is located behind said concave mirror surface, said front support having a viewing area removed therefrom to permit visual access to said two-sided optically-transparent convex lens.

14. The optical toy recited in claim 13, wherein said optical components carrier also comprises spacers located between the front and rear supports to retain said front and rear supports in spaced parallel alignment across said frame.

15. An optical toy including optical components adapted to enable a user to see a 3-dimensional image that is representative of an object held in front of the toy, an optical components carrier to which said optical components are attached, said optical components comprising a two-sided optically-transparent convex lens and a reflective concave mirror surface located behind the two-sided optically-transparent convex lens, whereby the object held in front of the two-sided optically-transparent convex lens is reflected by the reflective concave mirror surface so as to appear to the user in said two-sided optically-transparent convex lens in 3 dimensions, and a frame surrounding said optical components carrier and said optical components attached to said optical components carrier, said optical components carrier comprising front and rear supports extending across said frame for holding said two-sided optically-transparent convex lens in front of said reflective concave mirror surface, wherein the front support of said optical components carrier is located in front of said two-sided optically-transparent convex lens, and the rear support of said optical components carrier is located behind said reflective concave mirror surface, said front support having an open viewing area to permit visual access to said two-sided optically-transparent convex lens.

16. The optical toy recited in claim 15, wherein said two-sided optically-transparent convex lens is a Fresnel lens.

* * * * *